US006666349B1

(12) United States Patent
Gavin

(10) Patent No.: US 6,666,349 B1
(45) Date of Patent: Dec. 23, 2003

(54) SEPTIC SYSTEM TANK

(76) Inventor: Norman W. Gavin, 173 Church St., Yalesville, CT (US) 06492

( * ) Notice: Subject to any disclaimer, the term of this patent is extended or adjusted under 35 U.S.C. 154(b) by 43 days.

(21) Appl. No.: 10/004,198

(22) Filed: Nov. 1, 2001

Related U.S. Application Data

(60) Provisional application No. 60/256,449, filed on Dec. 18, 2000.

(51) Int. Cl.[7] ..... B65D 17/28

(52) U.S. Cl. ..... 220/567.1; 220/484; 220/661

(58) Field of Search ..... 220/484, 567.1, 220/565, 571, 601, 661, 3.7, 676

(56) References Cited

U.S. PATENT DOCUMENTS

| | | | | |
|---|---|---|---|---|
| 4,080,813 A | | 3/1978 | McKann | |
| 4,562,369 A | | 12/1985 | Gerlach et al. | |
| 4,663,036 A | | 5/1987 | Strobl, Jr. et al. | |
| 4,732,397 A | | 3/1988 | Gavin | |
| 4,789,487 A | | 12/1988 | Wallace | |
| 5,444,183 A | * | 8/1995 | Gehrs et al. | 174/65 R |
| 5,655,564 A | | 8/1997 | Gavin | |
| 5,772,361 A | | 6/1998 | Gavin | |
| 6,076,993 A | | 6/2000 | Gray | |

OTHER PUBLICATIONS

1997 Tuf–Tite (tm) Corporation installation instruction, form 4HD2–2, for a 4–hole plastic distribution box4HD2 which is sold with a single permanent hole on one side of the box that is lower than a single permanent hole on another side of the box.

Tuf–Tite (tm) sheet showing pipes through seals on a 4–hole distribution box.

* cited by examiner

*Primary Examiner*—Stephen Castellano
(74) *Attorney, Agent, or Firm*—Robert A. Seemann

(57) ABSTRACT

A septic system tank vertical wall has vertically overlapping grooved rings having specific diameters for receiving existing sealing couplers for septic system pipe. One wall of the groove has portions at different angles from the wall. The grooves are at the same depth and discontinuous at their intersections.

4 Claims, 13 Drawing Sheets

8/13

SEPTIC SYSTEM TANK

This application claims the benefit of U.S. Provisional Application No. 60/256,449, filed Dec. 18, 2000.

BACKGROUND OF THE INVENTION

1. Field of the Invention

The invention pertains to underground septic system tanks such as a distribution tank, fluid separator tank, and settling tank, that is adapted for burial directly in the soil, which is connected by pipe to other elements of the septic system.

2. Description of the Prior Art

A septic system underground tank is cast with permanent lateral openings or holes for receiving septic system pipe. For various reasons including accessability, water table, and local rules, the tank must be buried at a specific depth, and the pipe must be attached to the tank at a specific depth. This means that the tank has to be ordered with the holes at a specific height between the top and the bottom of the tank. Alternatively, the tank can be purchased without any holes, and holes have to be cut through the side at the construction site. The later choice is time and labor consuming, requires additional on-site tools and carries with it the chance of damaging the tank. An example of a Prior Art tank is described in FIG. 1 below. A septic system underground tank with seal apparatus for it, is disclosed in U.S. Pat. No. 4,663,036 patented May 5, 1987 by Strobl, Jr. et al.

SUMMARY OF THE INVENTION

It is one object of the invention to provide a septic system tank that can be buried to a specific depth relative to the earth or to the top or bottom of other tanks in the system while one or more pipes can be connected to the tank at any one of a plurality of different heights between the top and the bottom of the tank. Other objects and advantages of the invention will become apparent to persons skilled in the art from the ensuing description.

A septic system plastic fluid distribution tank adapted for subterranean burial, having a top and a bottom, includes a first vertical outer wall, a plurality of grooved annular circuits molded on the wall of equal diameter, extending in vertical overlapping sequence, the centers of the annular circuits being vertically spaced from one another, formed on the wall so that a hole can be made through the wall at any height of a plurality of heights between the top and the bottom of the wall by removing the portion of the wall that is circumscribed by the circuit at the desired height.

Preferably, at least one circuit of the plurality of grooved circuits is discontinuous at an intersection with another circuit of the plurality of grooved annular circuits.

Preferably the side of the groove that is toward the outer diameter of the circuit slopes at at least two different angles from the outer wall of the tank.

Preferably the opposite sides of at least one groove of the plurality of grooved annular circuits slope asymmetrically in cross section.

A plate, molded with in one piece with the tank is mounted on the bottom of the tank by a living hinge configured for vertical movement of the plate.

BRIEF DESCRIPTION OF THE DRAWINGS

In order that the invention will be more fully comprehended, it will now be described, by way of example, with reference to the accompanying drawings in which.

DESCRIPTION OF THE PREFERRED EMBODIMENTS

Figure 1:
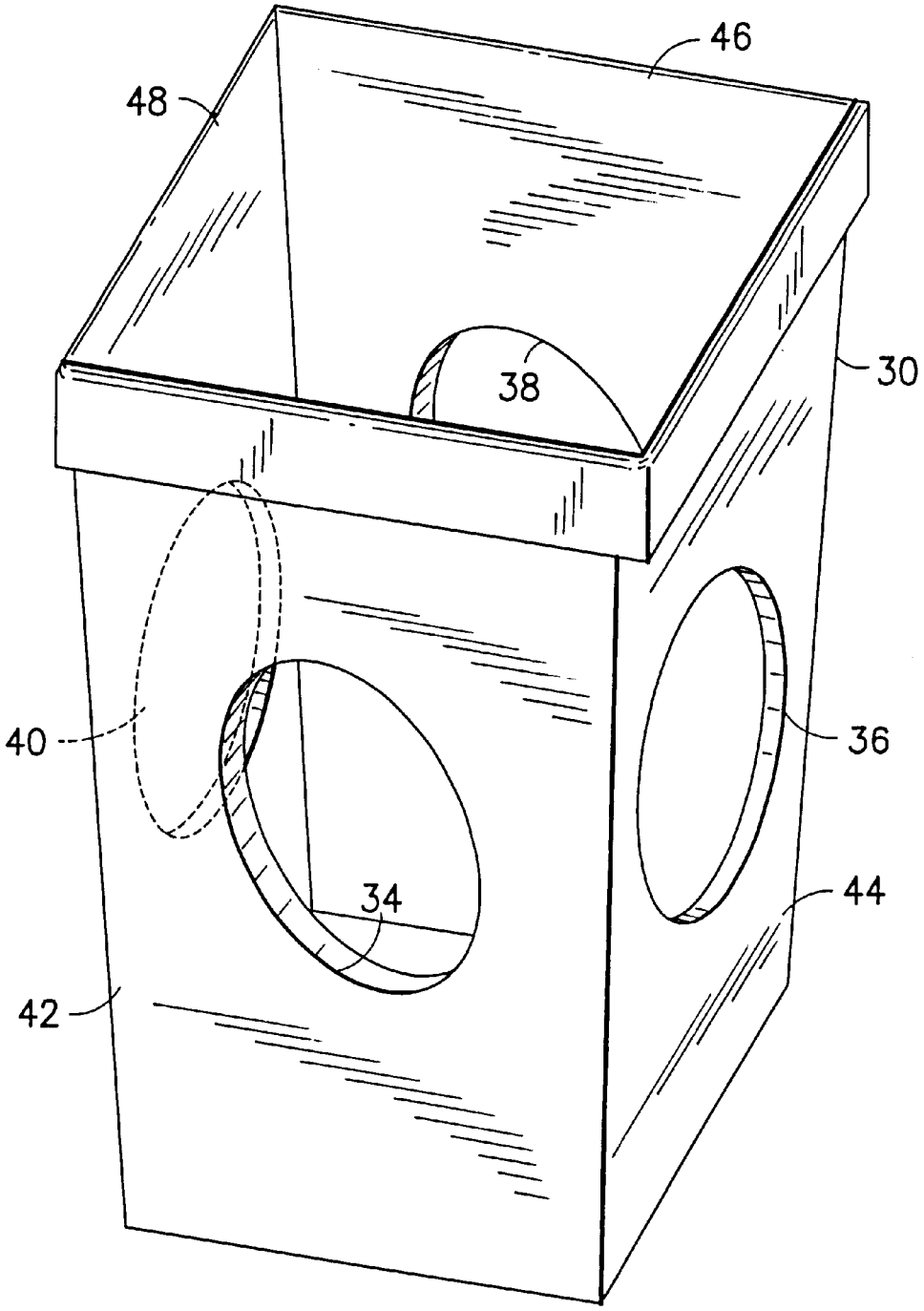
FIG. 1 PRIOR ART
FIG. 1 is a perspective view of a PRIOR ART septic system underground tank.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

In FIG. 1, Prior Art tank 30 is a septic system low pressure fluid distribution box adapted for subterranean burial. It is molded of plastic. Holes 34, 36, 38 and 40 are sawed through walls 42, 44, 46 and 48 respectively. The diameter of the holes is such that each hole receives a pipe receiving coupler that seals around a pipe to the respective wall. A twist-in seal or pipe receiving coupler for septic tank pipe, for plastic septic system distribution boxes is made by American Manufacturing Co. Inc., Manassas, Va. 2018–0549 Pipe receiving couplers for a septic system plastic distribution box are described in U.S. Pat. No. 5,655,564 patented Aug. 12, 1997 by N. Gavin. U.S. Pat. No. 5,655,564 is hereby incorporated by reference. A pipe receiving coupler, like seal 18 described in U.S. Pat. No. 4,732,397 patented Mar. 22, 1998 by N. Gavin can be mounted in a round hole in a plastic septic system fluid distribution box and sealingly fused by flange 26 or rim 28 in that patent by methods known to fastening art to the plastic wall surrounding the hole. U.S. Pat. No. 4,732,397 is hereby incorporated by reference. U.S. Pat. No. 4,663,036 describes a septic system box 20 having a plurality of holes 24, 28 through the sidewalls of the box and a flexible seal or pipe receiving coupler 32 that snap-fits into one of the holes. Empty holes are closed by seal plugs 88. U.S. Pat. No. 4,663,036 is hereby incorporated by reference.

Figure 2:
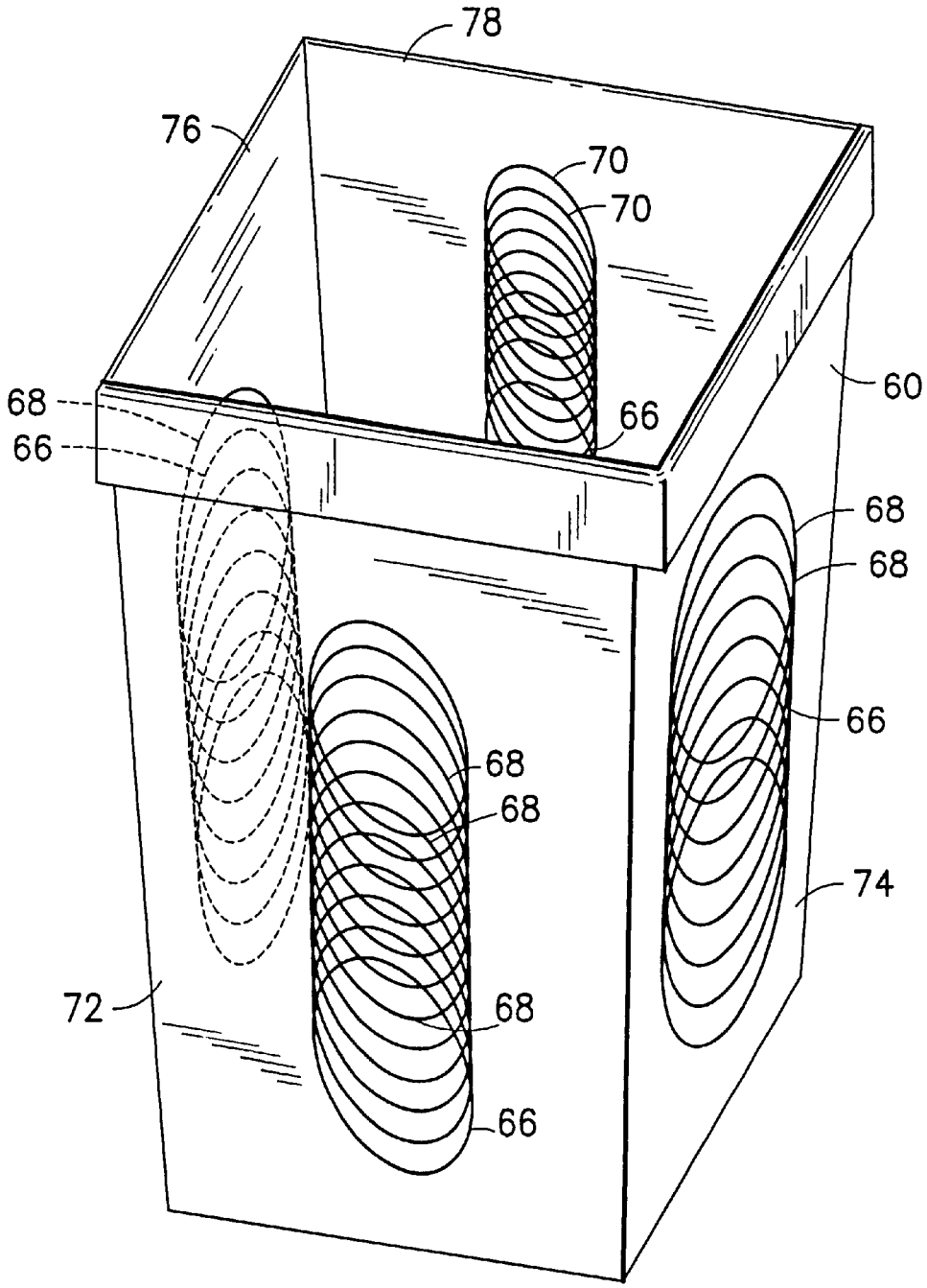
FIG. 2 is a perspective view of a septic system low pressure underground burial tank of the invention.

In FIG. 2, septic system low pressure tank 60 of the invention, which is adapted for subterranean burial, is molded of plastic. Molded integrally in one piece with tank 60 are a plurality of grooved annular or ring-shaped circuits 66 shown as rings 68 in walls 72, 74, and 76, and rings 70 in wall 78. Each of rings 68 has the same diameter. Each of rings 70 has the same diameter. Rings 68 are designed to provide a hole that receives a different size pipe or different size pipe receiving coupler for septic system pipe than the hole provided by each of rings 70. In other tanks of the invention, rings can be the same size all around the tank. This tank design is also called a septic system fluid distribution box.

Figure 3:
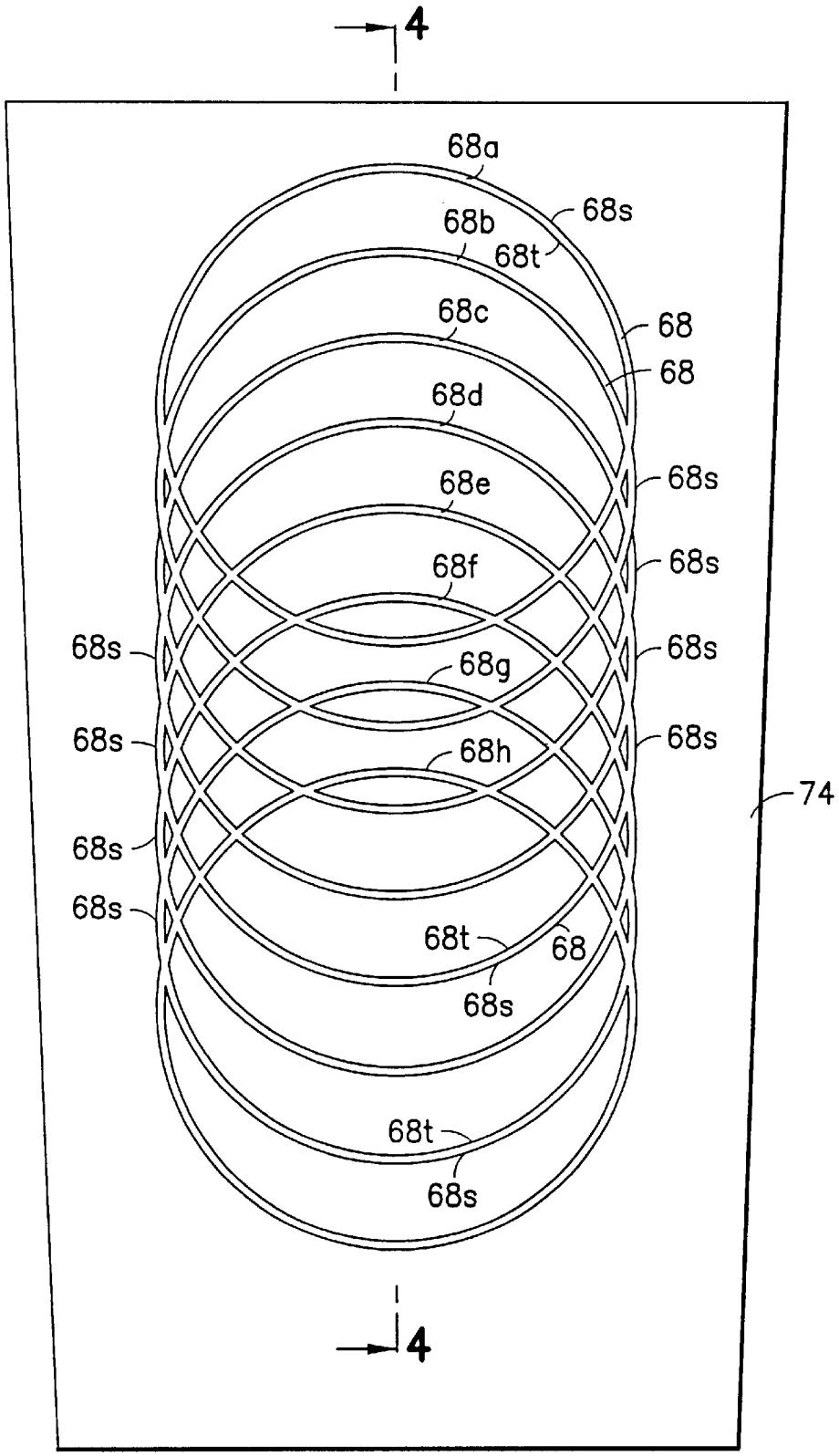
FIG. 3 is a schematic view of a vertical wall of the tank of FIG. 2 which includes grooved circuits in the form of rings.
Figure 4:
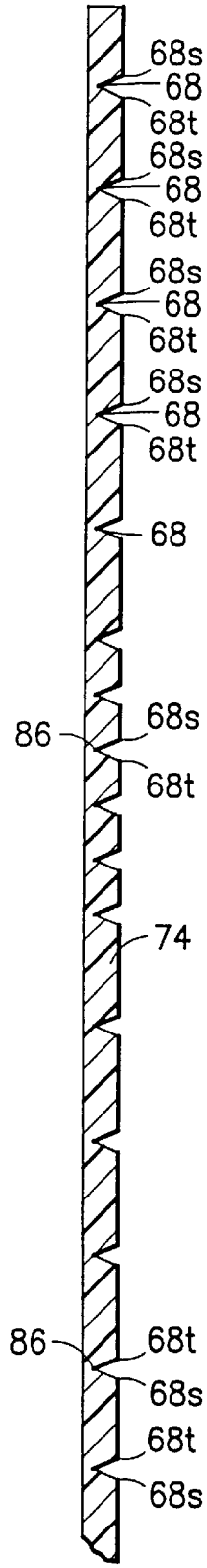
FIG. 4 is a cross section view of the vertical wall of FIG. 3, viewed along 4—4.
Figure 5:
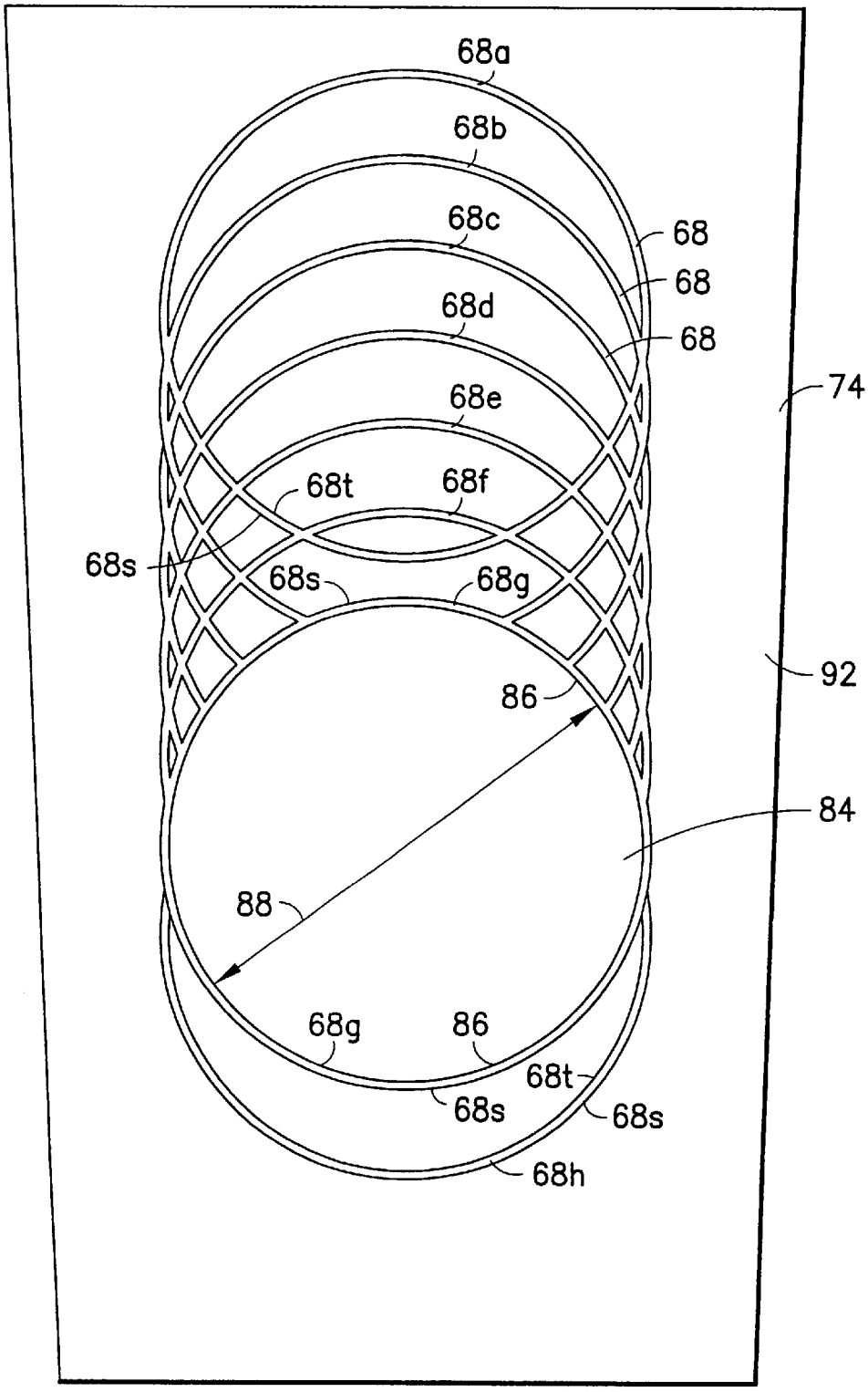
FIG. 5 is a schematic view of the vertical wall of FIG. 3 in which a hole is broken out of the side for receiving a pipe or pipe coupler.
Figure 6:
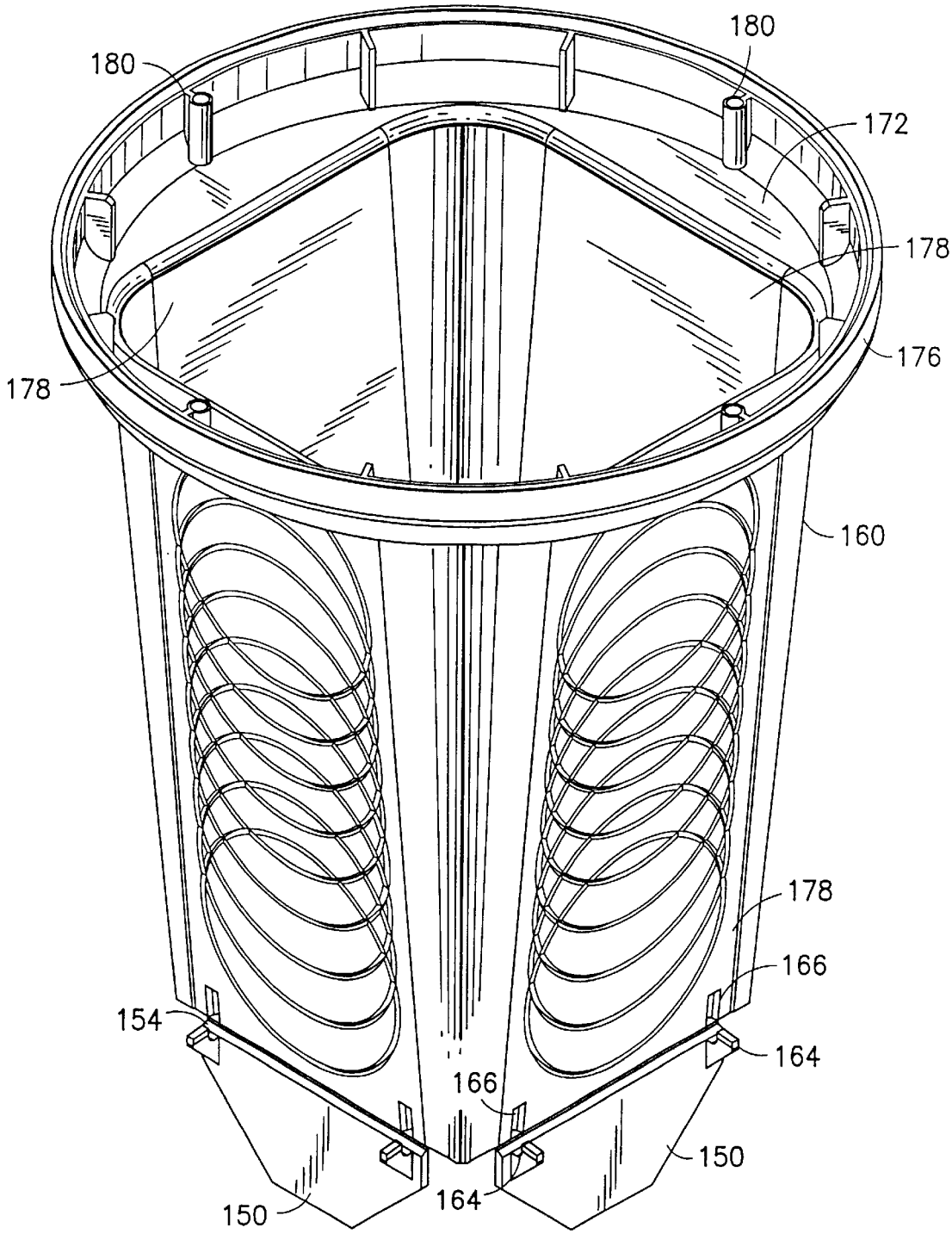
FIG. 6 is a perspective schematic view of another tank according to the invention.
Figure 7:
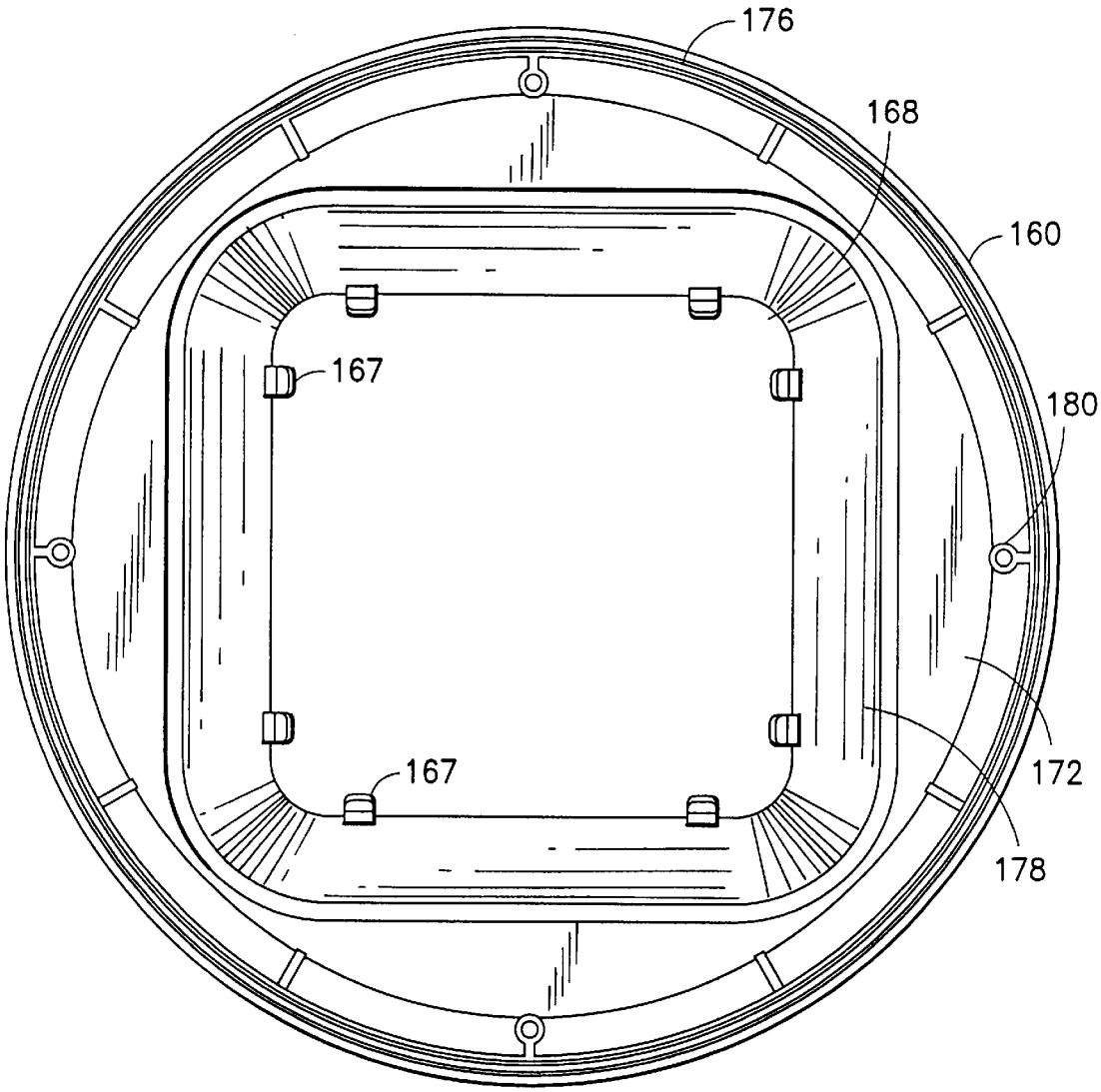
FIG. 7 is a schematic top view of the tank of FIG. 6.
Figure 8:
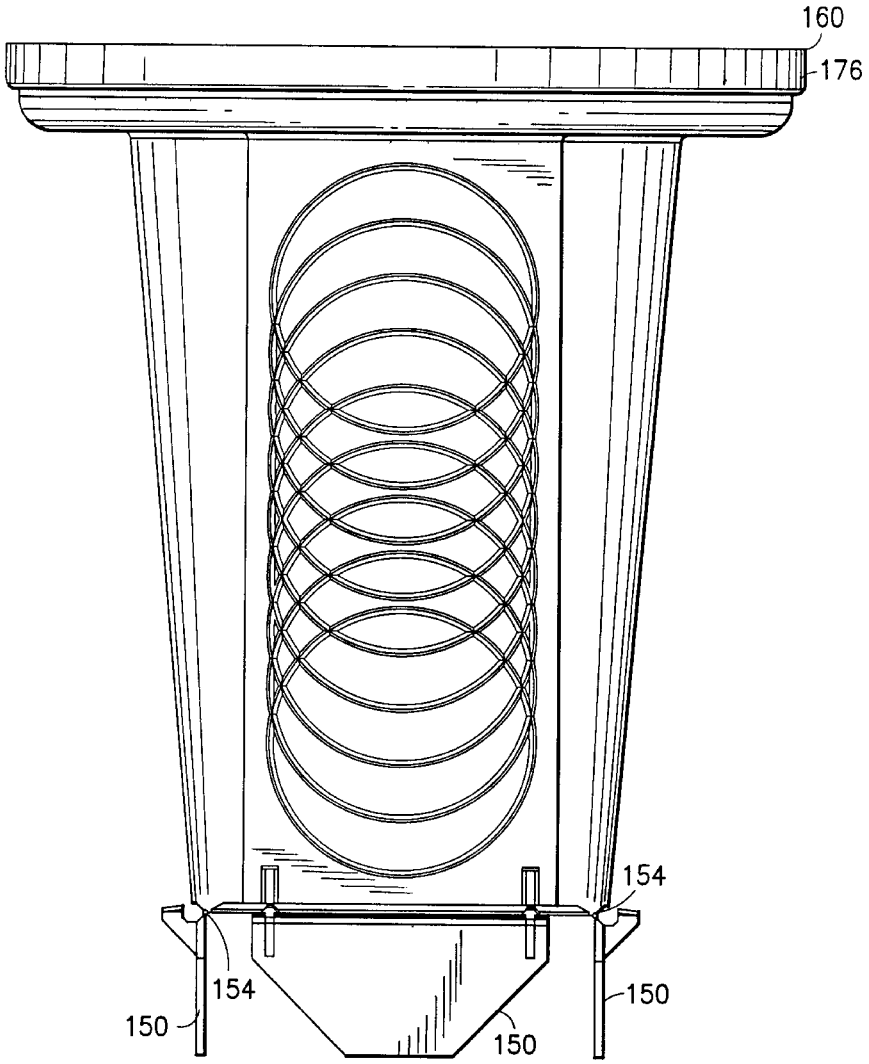
FIG. 8 is a schematic side view of the tank of FIG. 6.
Figure 9:
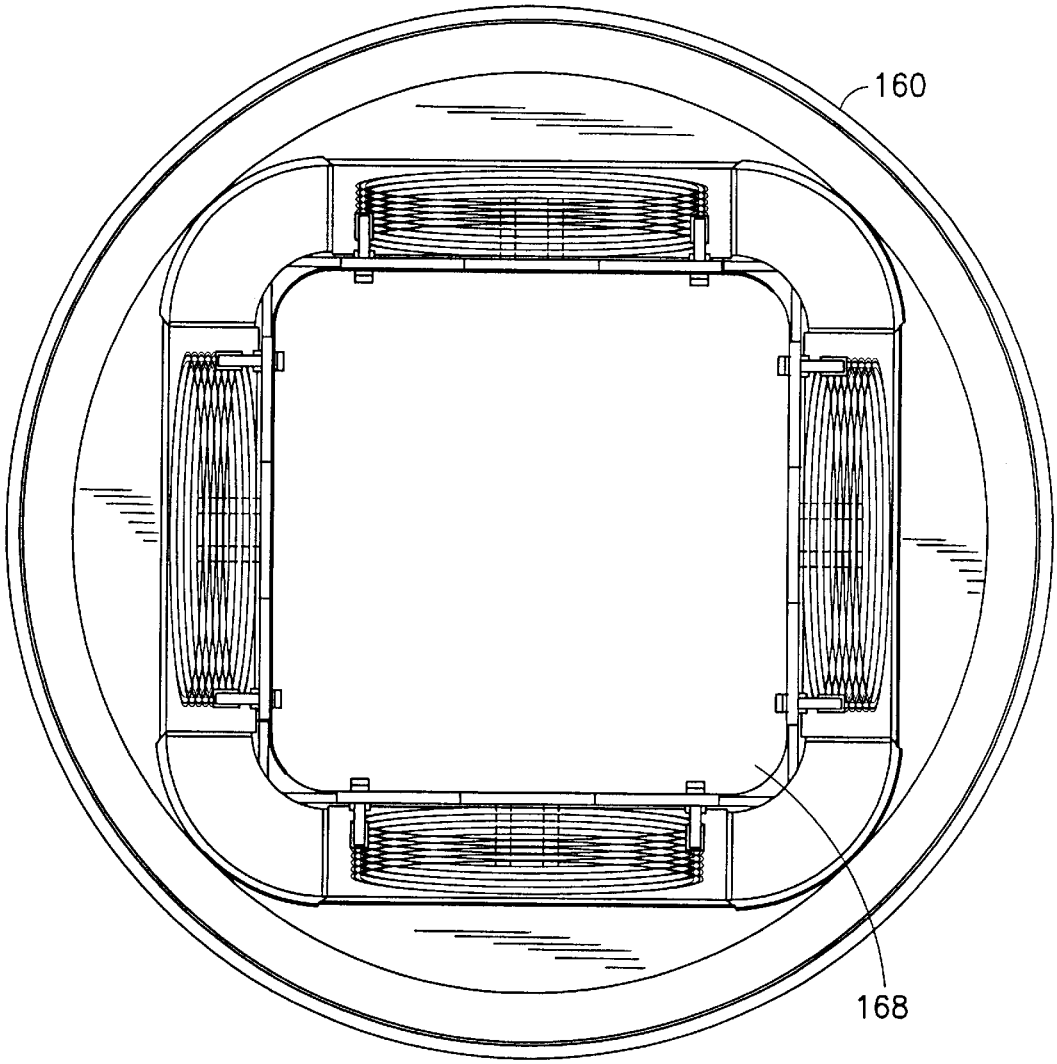
FIG. 9 is a schematic bottom view of the tank of FIG. 6.

Referring to FIGS. 3, 4, and 5, a hole is made by breaking out the portion of the wall that is circumscribed by the grooved annular circuit that is at the desired height on the wall. The circumference of the resulting hole is measured across the apex of the circuit's groove. The annular grooves are identified by 68*a*, 68*b*, 68*c*, 68*d*, 68*e*, 68*f*, 68*g*, 68*h*. In FIGS. 3 and 5, outer shoulders 68*s* and inner shoulders 68*t* of the intact grooved rings are shown, the apex of each groove is not shown. The apex 86 of each groove is shown in FIG. 4 and the apex of annular groove 68*g* is shown forming hole 84 in FIG. 5.

The diameter of the hole that is formed by removing the portion of wall that is within a ring is measured across the apex of the groove of the ring. For example hole 84 diameter 88 is measured across apex 86 of groove 68*g*.

Wall within the ring is removed by inserting a screw driver into the groove and prying out the wall material circumscribed by the ring. A knife can be run around in the groove to further weaken the annular groove.

A septic system pipe coupler for septic system tanks and distribution boxes is then inserted in or is mounted on the hole in various ways known to the art, and a pipe is inserted sealingly into the coupler. Fluid distribution by one or more pipes is provided by removing wall material of rings on one or more sides of the tank and mounting the pipes in the resulting holes.

In FIG. 5, on outer surface 92 of wall 74 shoulders of adjacent annular grooves 68*b*, 68*c*, 68*d*, 68*e*, 68*f*, and 68*h* extend to shoulder 68*s* of hole 84, and their groove apexes extend to groove apex 86.

Referring to FIGS. 6–9, earth anchor plate 150 folds on living hinge 154 from vertical, downward from the bottom of the tank to horizontal extension from the bottom of the tank. Preferably the plate 150 can fold from a generally horizontal position under molded plastic septic tank 160 to a horizontal position extending outward from the tank.

When the plate is horizontal, extending outward from the tank, clip 164 snaps into slot 166 holding the plate in the horizontal position while the tank is lowered into a hole in the ground. The back wall 167 of slot 166 can be seen in FIG. 7 where it is molded integrally with vertical wall 178 and bottom wall 168.

A septic tank adapted for burial in soil that includes a movable earth anchor like anchor 150 is described in U.S. Pat. No. 5,772,361 patented Jun. 30,1998 by N. Gavin. U.S. Pat. No. 5,772,361 is hereby incorporated by reference.

Horizontal sill 172 connects cylindrical connector rim 176 to vertical walls 178. Cylindrical rim 176 is configured in size and in attachment holes 180 to mate with existing extension tubes for access from above ground to buried septic tank vessels or for a cover to seal the top of the tank when it is buried in the earth.

Figure 10:
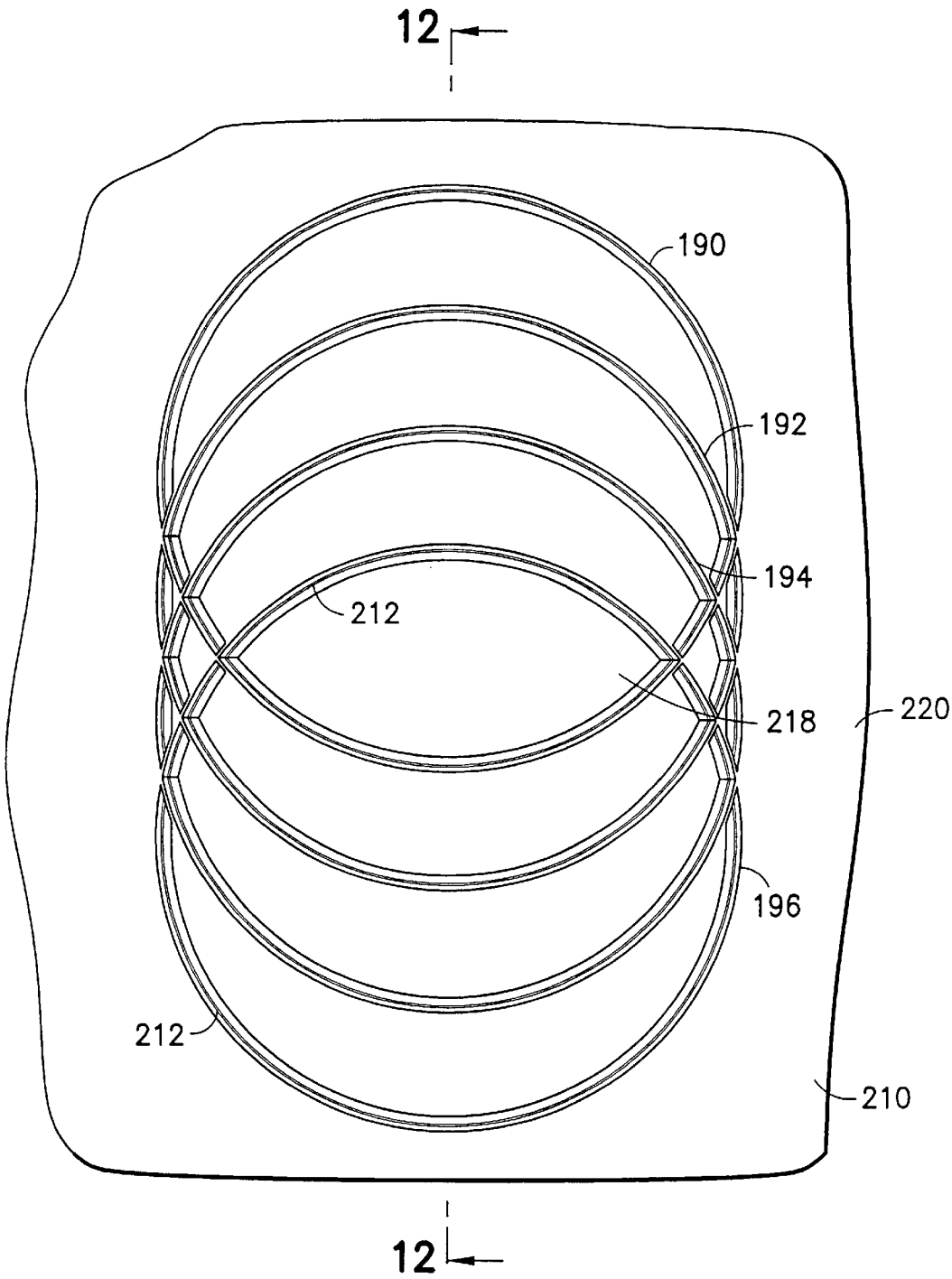
FIG. 10 is a schematic view of a vertical wall of another tank according to the invention.
Figure 11:
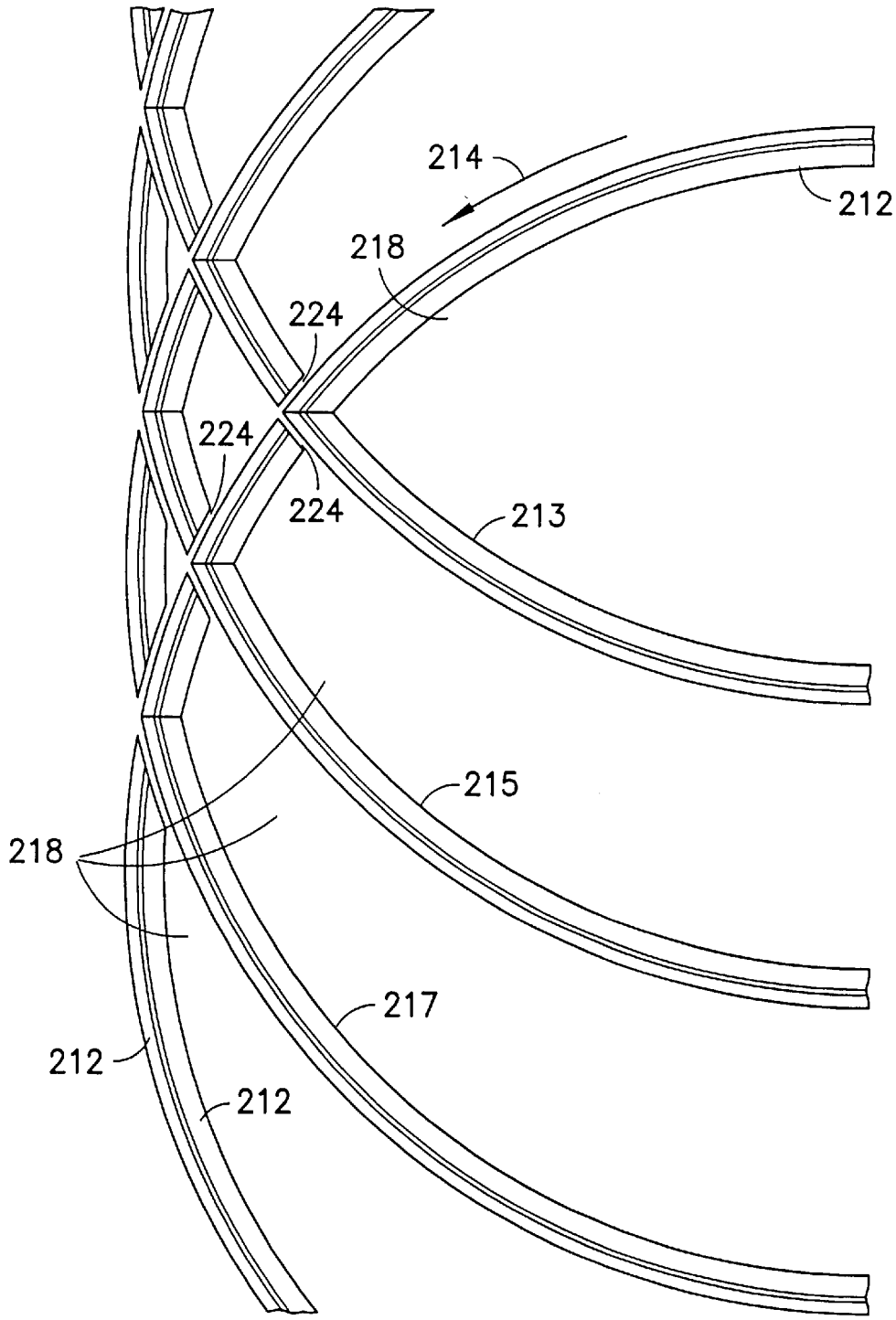
FIG. 11 is a magnified view of a portion of the grooved annular circuits in FIG. 10.

In FIGS. 10 and 11, grooved annular or ring-shaped circuits shown as rings 190, 192, 194 and 196 provide a choice of four different heights for removing circular portions of wall 210 of the septic tank for installing septic tank pipe in the wall of the vessel.

Referring to circuit 196 by way of example, a knife can be drawn in groove 212 which is on outside surface 220 of the wall, along arc 214 of the groove to further weaken the wall for knocking out material portion 218 that comprises the circular portion of the wall that will be removed.

At the intersections of grooves, 213, 215, and 217 which have their shoulders at the same height as the shoulders of groove 212 and have their apexes at the same depth below their shoulders, annular circuit 196 is broken or discontinuous. Material is left standing 224 or not grooved so that the vertically overlapping grooves are discontinuous with one another at their intersections. The blade is prevented by the discontinuities from being accidentally drawn into in intersecting circuit.

Figure 12:
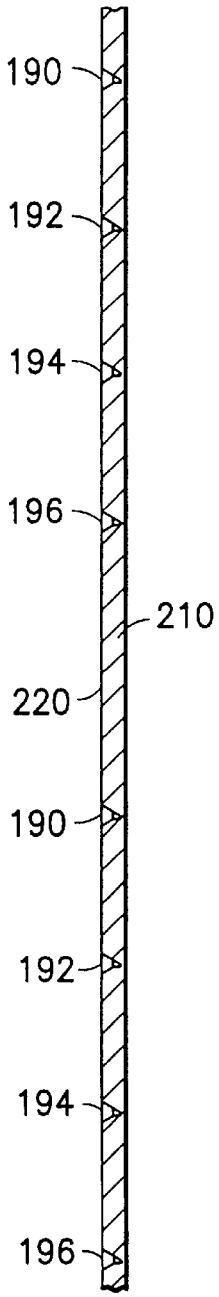
FIG. 12 is a cross section schematic view of the wall of FIG. 10 taken along 12—12.
Figure 13:
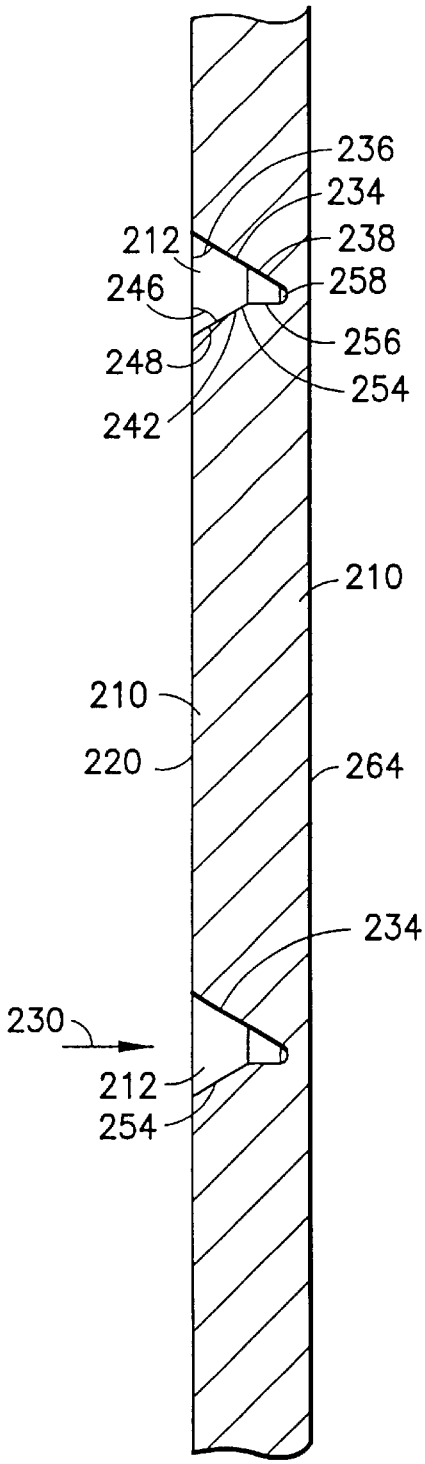
FIG. 13 is a magnified view of a portion of the wall of FIG. 12.

Referring to FIGS. 12 and 13, the knife, screwdriver or other edge is inserted 230 into groove 212 where it is guided by slope 234 of angle 236 of the circuit's inner diameter wall 238 of the groove, and slope 242 of angle 246 of the circuit groove outer diameter wall 248 which changes toward perpendicular, preferably to perpendicular in outer diameter wall 248 at portion 254, to portion 256, generally perpendicular to outside surface 220 of wall 210. Apex 258 of groove 212 is adjacent to inside surface 264 of wall 210 providing a weakened annular break-out line in the wall. The knife cuts material 224 at the discontinuity of the circuit in following arc 214.

Figure 14:
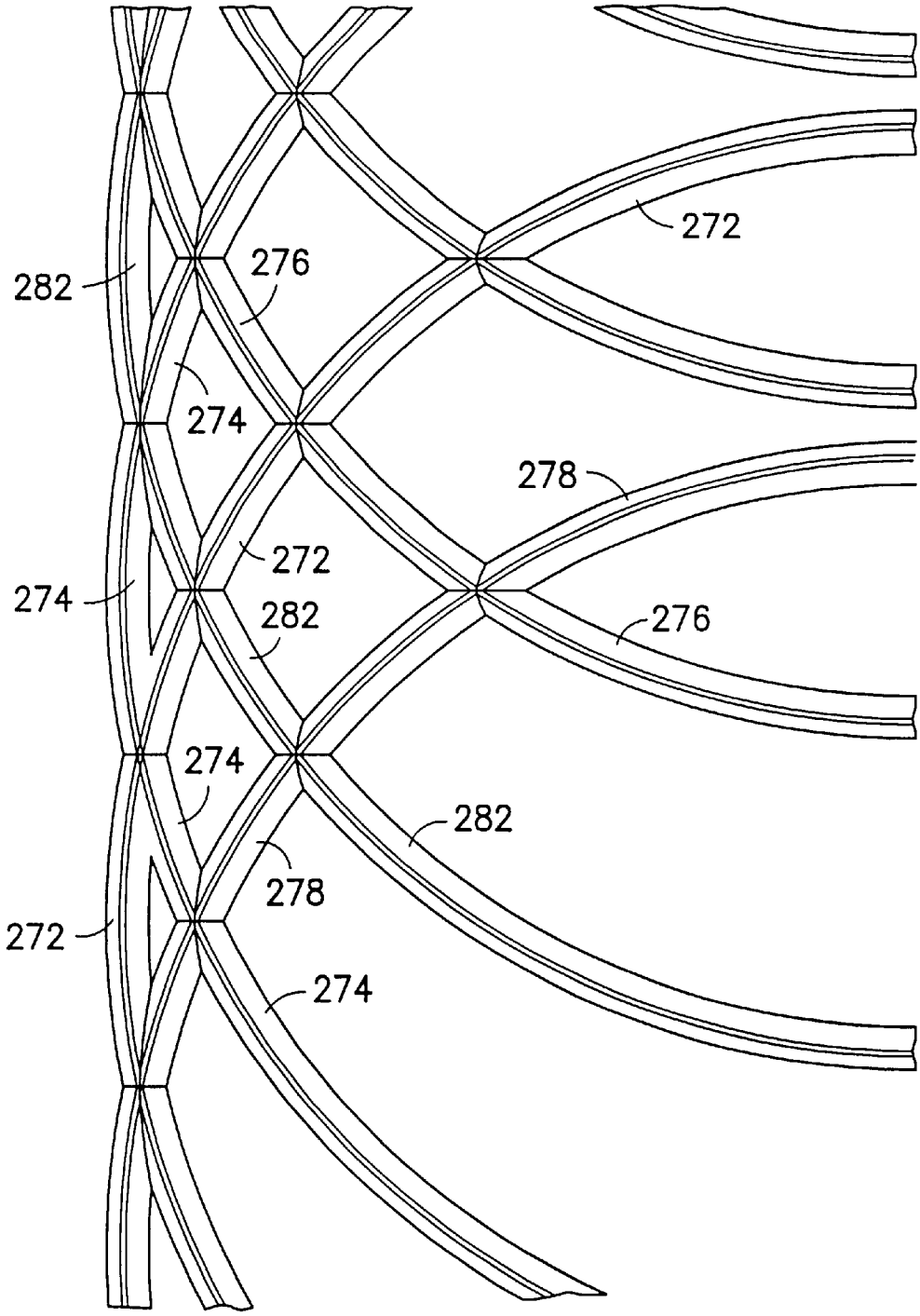
FIG. 14 is a magnified view of a portion of the grooved annular circuits on the wall of another tank according to the invention.

In FIG. 14, grooves 272, 274, 276, and 282 merge into one another where they cross. Although a knife can be used, material like 224 in FIG. 11 is not between the intersecting circle grooves to prevent their merging and to guide a knife away from straying from one circuit into an intersecting circuit.

The grooved circuits can be on the inside or the outside surface of the tank wall. They can be in any shape such that a seal can be made between the wall and septic system pipe that is connected to the hole made by groove for passing fluid through the hole between the tank interior and the pipe.

Preferably grooved circuits of the invention are designed to form a hole that is configured to receive existing pipe receiving couplers for septic tank system pipe. Although septic system pipe couplers on the market are generally designed to fit round holes, it should be understood that the grooved circuits can be in any shape to fit septic system pipe couplers, for examples circuits that are elliptical, and with angled corners.

Although the present invention has been described with respect to several embodiments thereof, it is to be understood that the scope of the invention is not limited by that description. It will be obvious to those skilled in the art that various modifications and substitutions may be made without departing from the spirit and scope of the invention.

I claim:

1. A plastic fluid distribution tank adapted for subterranean burial, having a top, and a bottom, comprising:

a first vertical outer wall having a top and a bottom, a plurality of grooved annular circuits molded on said wall, of equal diameter, extending in vertical overlapping sequence, the centers of the annular circuits being vertically spaced from one another, formed on the wall so that a hole can be made through the wall at any height of a plurality of heights between the top and the bottom of the wall by removing the portion of the wall that is circumscribed by the circuit at the desired height, at least two of the grooved circuits each being discontinuous at their intersection.

2. A plastic fluid distribution tank adapted for subterranean burial, having a top, and a bottom, comprising:

a first vertical outer wall having a top and a bottom, a plurality of grooved annular circuits molded on said wall, of equal diameter, extending in vertical overlapping sequence, the centers of the annular circuits being vertically spaced from one another, formed on the wall so that a hole can be made through the wall at any height of a plurality of heights between the top and the bottom of the wall by removing the portion of the wall that is circumscribed by the circuit at the desired height, at least one circuit of said plurality of grooved circuits being discontinuous at an intersection with another circuit of said plurality of grooved annular circuits.

3. The tank of claim 2, further comprising:

a plate, molded in one piece with said tank, mounted on the bottom of said tank by a living hinge configured for vertical movement of said plate.

4. A plastic fluid distribution tank adapted for subterranean burial, having a top and a bottom, comprising:

a first vertical outer wall having a top and a bottom, a plurality of grooved circuits molded on said wall, extending in vertical overlapping sequence, the centers of the circuits being vertically spaced from one another, formed on the wall so that a hole can be made through the wall at any height of a plurality of heights between the top and the bottom of the wall by removing the portion of the wall that is circumscribed by the circuit at the desired height, at least one circuit of said plurality of grooved circuits being discontinuous at an intersection with another circuit of said plurality of grooved circuits.

* * * * *